US006467683B2

(12) United States Patent
Jun

(10) Patent No.: US 6,467,683 B2
(45) Date of Patent: Oct. 22, 2002

(54) WATERPROOF KEYBOARD

(75) Inventor: John Jun, Shinguang (TW)

(73) Assignee: Silitek Corporation, Taipei (TW)

( * ) Notice: Subject to any disclaimer, the term of this patent is extended or adjusted under 35 U.S.C. 154(b) by 0 days.

(21) Appl. No.: 09/725,150

(22) Filed: Nov. 29, 2000

(65) Prior Publication Data

US 2002/0063149 A1 May 30, 2002

(51) Int. Cl.[7] ..... G06C 7/02
(52) U.S. Cl. ..... 235/145 R; 200/302.01
(58) Field of Search ..... 235/145 R, 145 A, 235/146; 200/302.2, 302.1, 344

(56) References Cited

U.S. PATENT DOCUMENTS 4,396,830 A * 8/1983 Isozaki et al. ..... 235/145 R
6,054,939 A * 4/2000 Wei et al. ..... 200/513
6,166,342 A * 12/2000 Chou ..... 200/344
6,215,420 B1 * 4/2001 Harrison et al. ..... 200/302.1

* cited by examiner

*Primary Examiner*—Karl D. Frech
*Assistant Examiner*—Daniel St. Cyr
(74) *Attorney, Agent, or Firm*—Rabin & Berdo, P.C.

(57) ABSTRACT

A waterproof keyboard is disclosed. The waterproof keyboard includes a top cover, a base, an orientating apparatus, and a conductive membrane above the base and a rubber sheet above the conductive membrane. The orientating apparatus has an orientating pillar extending from the top cover and connecting with the base so that the orientating apparatus fixes the top cover and the base together. The rubber sheet has a rubber orientating hole for the orientating apparatus to penetrate through. The rubber orientating hole binds up the orientating pillar so that undesired sputtered liquid can be prevented from the conductive membrane. The rubber sheet has a water-resistant edge with an opening so that liquid collected between the top cover and the rubber sheet can be led out through the opening of the water-resistant edge.

8 Claims, 2 Drawing Sheets

WATERPROOF KEYBOARD

BACKGROUND OF THE INVENTION

This application incorporates by reference Taiwanese application Ser. No. 89217425, Filed Oct. 6, 2000.

1. Field of the Invention

The invention relates in general to a waterproof inputting equipment, and more particularly to a waterproof keyboard using a rubber sheet.

2. Description of the Related Art

The advances in technology bring a great deal of convenience to people. For example, electric appliances and computer-related equipment have now played an important role in people's daily life. A key to maintain the performance of electrical equipment is to avoid liquid sputtering and increase the water-resistant of the electrical equipment because liquid sputtering in the electrical equipment may cause the damage of the interior electrical devices, short circuit and therefore shortens its life.

Conventionally, rubber sheets are used to prevent liquid sputtering. However, the orientating holes of the conventional rubber sheets are too big so that sputtered liquid might flow into the conductive membrane underneath, which frequently results in short circuit. Moreover, the conventional water-resistant edge of the rubber sheet is in a close design. As a result, liquid at the rubber sheet can not be drained out of the keyboard and vapor tends to generate inside.

SUMMARY OF THE INVENTION

It is therefore an object of the invention to provide an improved waterproof keyboard, which makes use of a rubber sheet to tightly binds up the fixing apparatus. Consequently, the performance of the conductive membrane can be maintained. Moreover, the open design Of the water-resistant edge of the rubber sheet can successfully drain sputtered liquid out of the keyboard.

It is another object of the invention to provide a waterproof keyboard, which includes: a top cover mounted with a number of keys; a base; an orientating apparatus, a conductive membrane disposed above the base and a rubber sheet disposed above the conductive membrane. The orientating apparatus has an orientating pillar extending from the top cover and connecting with the base so that the orientating apparatus fixes the top cover and the base together. The rubber sheet has a rubber orientating hole for the orientating apparatus to penetrate through. The rubber orientating hole binds up the orientating pillar so that undesired sputtered liquid can be prevented from the conductive membrane. The orientating pillar of the orientating apparatus has a space inside and the orientating apparatus further includes a base orientating hole and a fixing device. The base orientating hole is on the base and in conjunction with the space of the orientating pillar. The base orientating hole and the space of the orientating pillar together form a continuous space and the fixing device is inserted into the continuous space so that the top cover and the base are fixed. The rubber sheet has a water-resistant edge with an opening so that liquid collected between the top cover and the rubber sheet can be led out through the opening of the water-resistant edge.

It is therefore another object of the invention to provide a water-resistant rubber sheet for using in a keyboard. The keyboard includes a top cover, a base, a conductive membrane and an orientating apparatus. The water-resistant rubber sheet includes a rubber orientating hole binding up the orientating apparatus so that undesired sputtered liquid can be prevented from penetrating the rubber sheet. The water-resistant rubber sheet can further have a water-resistant edge with an opening so that liquid collected between the top cover and the rubber sheet can be led out through the opening of the water-resistant edge. The liquid led out of the rubber sheet is then led out to a flow-collecting region of the base and flows out of the waterproof keyboard through an opening of the base.

BRIEF DESCRIPTION OF THE DRAWINGS

Other objects, features, and advantages of the invention will become apparent from the following detailed description of the preferred but non-limiting embodiments. The description is made with reference to the accompanying drawings in which.

DESCRIPTION OF THE PREFERRED EMBODIMENT

Figure 1:
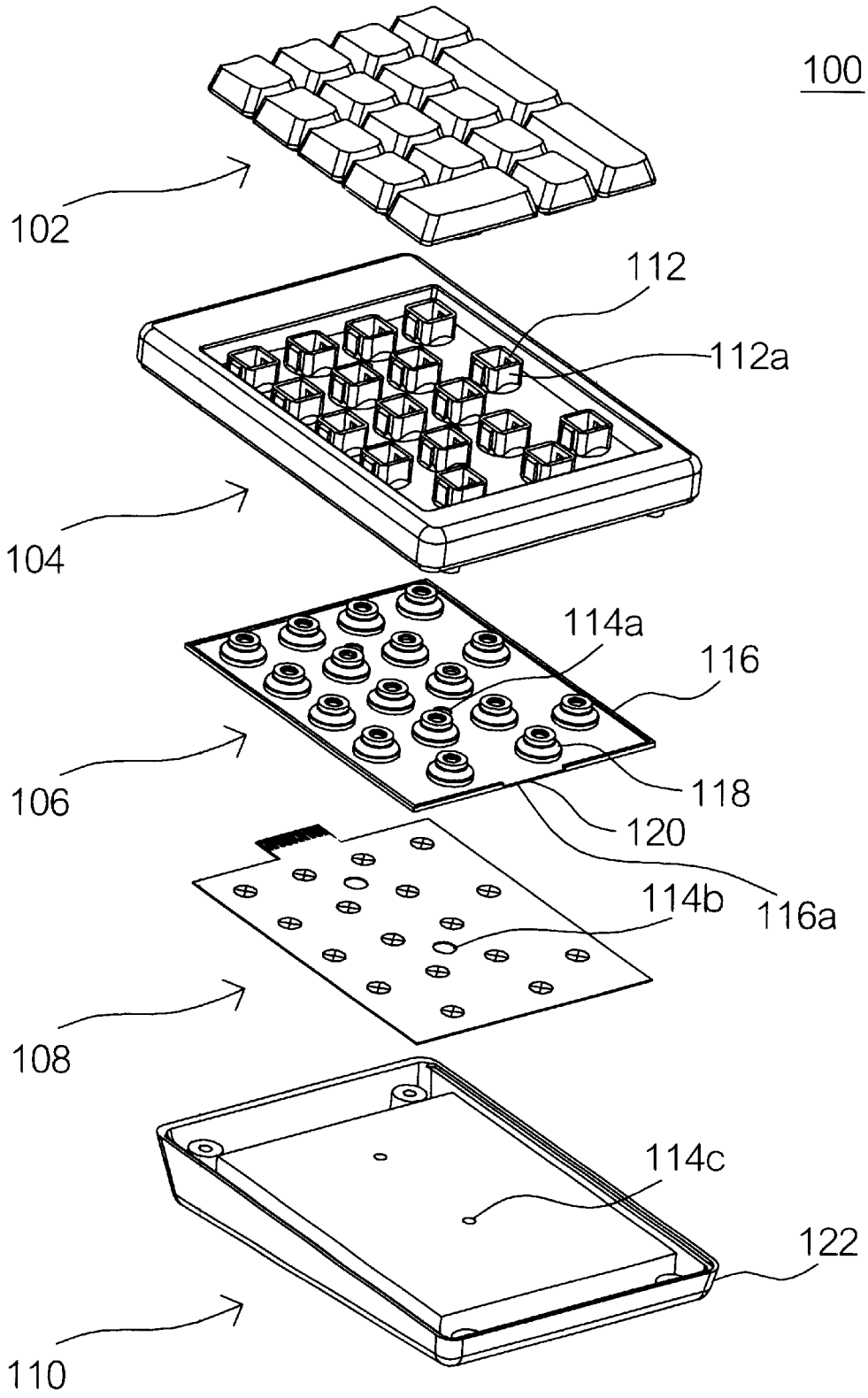
FIG. 1 shows each layer of a waterproof keyboard according to a preferred embodiment of the invention.
Figure 2A:
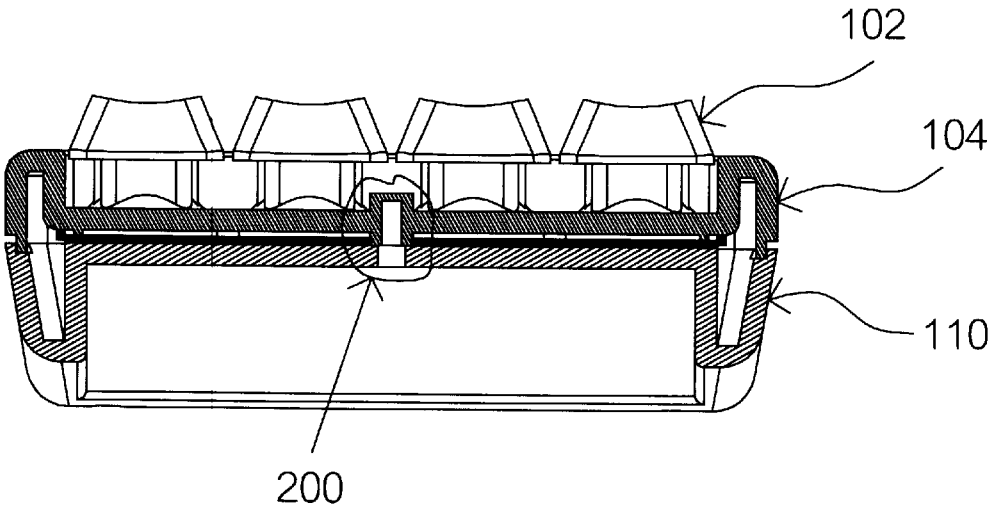
FIG. 2A is the cross section of the waterproof keyboard according to a preferred embodiment of the invention.
Figure 2B:
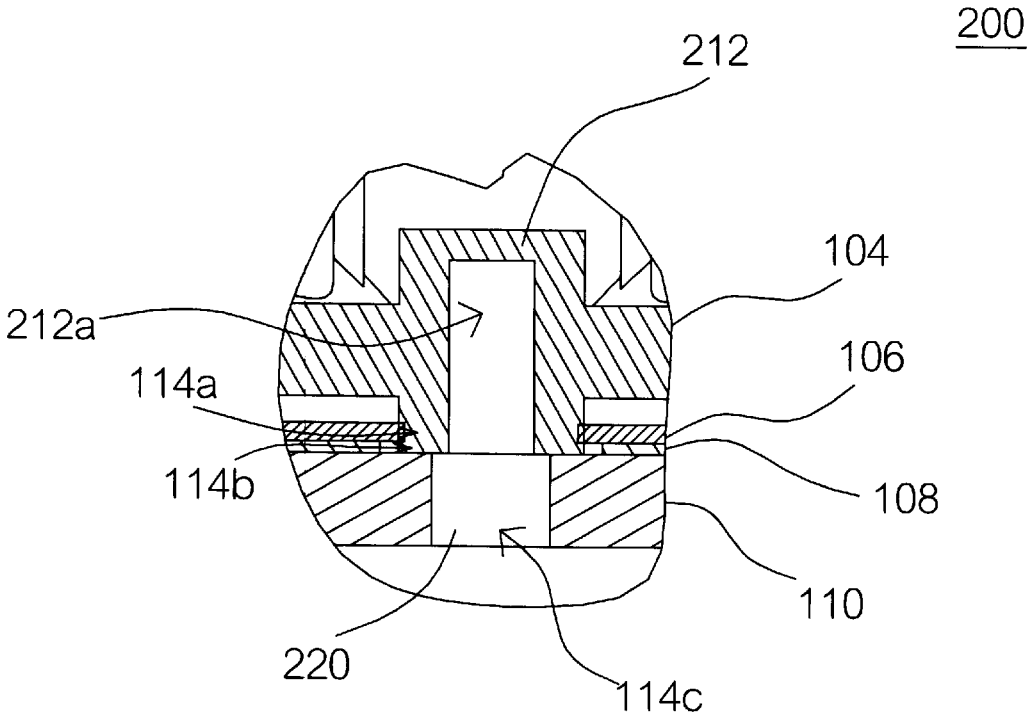
FIG. 2B shows the details of the orientating apparatus 200 as shown in FIG. 2A.

The waterproof keyboard 100 according to a preferred embodiment of the invention, as shown in FIG. 1, mainly includes a top cover 104, a rubber sheet 106, a conductive membrane 108 and a base 110 from top to bottom. The waterproof keyboard of the invention further includes an orientating apparatus 200, as shown in FIG. 2. The top cover 104 includes a number of rectangular holes 112. The rectangular holes 112 further have edges 112*a* extending towards the keys 102 for connecting with the keys 102. The rubber sheet 106 is disposed under the top cover 104 and above the conductive membrane 108. The rubber sheet 106 has a number of rubber caps 118 formed on it. The rubber caps 118 can be inserted into rectangular holes 112 to connect with the keys 102. The movement of the rubber cap 118 depends on the press or release of the corresponding key 102 and further controls the on/off of the circuit by connecting the conductive membrane 108. Referring to FIG. 2A, a cross section of the waterproof keyboard according to a preferred embodiment of the invention is shown. As shown in FIG. 2A, the orientating apparatus 200 fixes the top cover 104, the rubber sheet 106, the conductive membrane 108 and the base 110 together. FIG. 2B shows the details of the orientating apparatus 200. The orientating apparatus 200 includes an orientating pillar 212, a base orientating hole 114*c* at the base at the base 110, and a fixing device 220. The orientating pillar 212 is a part of the top cover 104, extending toward the base 110 and having a space 212*a* formed inside. The base orientating hole 114*c* and the space 212*a* together form a continuous space. The rubber sheet 106 and the conductive membrane 108 respectively have orientating hole 114*a* and orientating hole 114*b*. The fixing device 220, such as a screw, is screwed or inserted in the above-mentioned continuous space and penetrates through the orientating hole 114*a* and the orientating hole 114*b* to tight up and fix the top cover 104 and the base 110 together. As shown, the orientating hole 114*a* of the rubber sheet 106 has a diameter that is less than a diameter of the orientating pillar, so that according to a preferred embodiment of the invention the hole 114*a* binds up the orientating pillar 212 so that water can be prevented from the conductive membrane 108 and be collected between the rubber sheet 106 and the top cover 104. As shown in FIG. 1, according to a preferred embodiment of the invention, the rubber sheet 106 has a water-resistant edge 116 with an opening 116*a*. Water collected between the top cover 104 and the rubber sheet 106 can be led to the flow-collecting region 122 at the base 110 through the opening 116*a*. Furthermore, water in the flow-collecting region 122 can be led outside the keyboard 100 by any opening (not shown) of the flow-collecting region 122.

It is therefore apparent that the waterproof keyboard having the following advantages:

1. No liquid will be able to penetrate through the rubber sheet since the rubber sheet bind s up the orientating pillar.

2. Short circuit caused by undesired liquid sputtering can be completely prevented.

3. Compared with other conventional waterproof machinery of a keyboard, the waterproof keyboard having special designs of the rubber sheet and the base does not include extra cost.

4. Sputtered liquid can be collected in the flow-collecting region and led out of the keyboard so that no water vapor will be generated.

While the invention has been described by way of example and in terms of the preferred embodiment, it is to be understood that the invention is not limited to the disclosed embodiment. To the contrary, it is intended to cover various modifications and similar arrangements and procedures, and the scope of the appended claims therefore should be accorded the broadest interpretation so as to encompass all such modifications and similar arrangements and procedures.

What is claimed is:

1. A waterproof keyboard, comprising:

a top cover mounted with a plurality of keys;

a base;

an orientating apparatus, wherein the orientating apparatus has an orientating pillar extending from the top cover and connecting with the base so that the orientating apparatus fixes the top cover and the base together;

a conductive membrane disposed above the base; and a rubber sheet disposed above the conductive membrane, wherein the rubber sheet has a rubber orientating hole for the orientating apparatus to penetrate through and the rubber orientating hole binds up the orientating pillar so that undesired sputtered liquid can be prevented from contacting the conductive membrane;

wherein the orientating pillar of the orientating apparatus has a space inside and wherein the orientating apparatus further comprises:

a base orientating hole on the base and in conjunction with the space of the orientating pillar, wherein the base orientating hole and the space of the orientating pillar together for a continuous space; and a fixing device which is inserted into the continuous space so that the top cover and the base are fixed; and wherein the rubber orientating hole has a diameter that is less than an outermost diameter of said orientating pillar so that when the orientating pillar penetrates through the robber orientating hole, the hole surrounds and engages the outermost diameter of said orientating pillar.

2. The waterproof keyboard as claimed in claim 1, wherein the top cover has a plurality of rectangular holes and each of the rectangular hole is mounted with one of the keys.

3. The waterproof keyboard as claimed in claim 1, wherein the fixing device is a screw.

4. The waterproof keyboard as claimed in claim 1, wherein the conductive membrane has an orientating hole for the orientating apparatus to penetrate through.

5. The waterproof keyboard as claimed in claim 1, wherein the rubber sheet has a number of rubber caps, each rubber cap is inserted into a respective rectangular hole of the holes to connect with a corresponding key of the keys, and wherein the movement of said each rubber cap depends on the press or release of the corresponding key and controls the on/off of a circuit by connecting the conductive membrane.

6. A waterproof keyboard, comprising:

a top cover mounted with a plurality of keys;

a base;

an orientating apparatus, wherein the orientating apparatus has an orientating pillar extending from the top cover and connecting with the base so that the orientating apparatus fixes the top cover and the base together;

a conductive membrane disposed above the base; and a rubber sheet disposed above the conductive membrane, wherein the rubber sheet has a rubber orientating hole for the orientating apparatus to penetrate through and the rubber orientating hole binds up the orientating pillar so that undesired sputtered liquid can be prevented from contacting the conductive membrane, wherein the rubber sheet has a water-resistant edge with an opening so that liquid collected between the top cover and the rubber sheet can be led out through the opening of the water-resistant edge; and wherein the rubber orientating hole has a diameter that is less than an outermost diameter of said orientating pillar so that when the orientating pillar penetrates through the rubber orientating hole, the bole surrounds and engages the outermost diameter of said orientating pillar.

7. The waterproof keyboard as claimed in claim 6, wherein the orientating pillar of the orientating apparatus has a space inside and wherein the orienting apparatus further comprises:

a base orientating hole on the base and in conjunction with the space orientating pillar, wherein the base orientating hole and the space of the orientating pillar together for a continuous space and a fixing device which is inserted into the continuous space so that the top cover and the base are fixed.

8. The waterproof keyboard as claimed in claim 6, wherein the liquid led out of the rubber sheet is then led out to a flow-collecting region of the base and flows out of the waterproof keyboard through an opening of the base.

* * * * *